US011278120B2

(12) United States Patent
Bryant

(10) Patent No.: US 11,278,120 B2
(45) Date of Patent: Mar. 22, 2022

(54) RECLINER SEATING MECHANISM WITH SEAT EXTENSION

(71) Applicant: L&P PROPERTY MANAGEMENT COMPANY, South Gate, CA (US)

(72) Inventor: Jason Allan Bryant, Mooreville, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 17/135,235

(22) Filed: Dec. 28, 2020

(65) Prior Publication Data

US 2021/0112983 A1 Apr. 22, 2021

Related U.S. Application Data

(63) Continuation of application No. 16/244,700, filed on Jan. 10, 2019, now Pat. No. 10,881,209.

(60) Provisional application No. 62/616,864, filed on Jan. 12, 2018.

(51) Int. Cl.

| | |
|---|---|
| ***A47C 1/03*** | (2006.01) |
| ***A47C 1/034*** | (2006.01) |
| ***A47C 1/032*** | (2006.01) |

(52) U.S. Cl.

CPC ..... *A47C 1/0345* (2013.01); *A47C 1/0347* (2013.01)

(58) Field of Classification Search

CPC ... A47C 1/0324; A47C 1/0345; A47C 1/0347; A47C 1/034; A47C 1/0352; A47C 1/023; A47C 1/022; A47C 1/024; A47C 1/0242; A47C 7/506; B60N 2002/0204; B60N 2002/0208; B60N 2002/0212; B60N 2002/0216

USPC ..... 297/89

See application file for complete search history.

(56) References Cited

U.S. PATENT DOCUMENTS

| | | | | |
|---|---|---|---|---|
| 3,102,756 A | | 9/1963 | Strasser | |
| 4,776,634 A | | 10/1988 | Pugliese | |
| 5,577,807 A | | 11/1996 | Hodge et al. | |
| 5,971,475 A | * | 10/1999 | Lawson | A47C 1/0355 297/68 |
| 5,975,627 A | | 11/1999 | LaPointe et al. | |
| 6,394,549 B1 | | 5/2002 | DeKraker et al. | |
| 6,994,400 B2 | | 2/2006 | Koepke et al. | |

(Continued)

FOREIGN PATENT DOCUMENTS

| | | |
|---|---|---|
| AT | 211499 B | 10/1960 |
| CN | 1905821 A | 1/2007 |

(Continued)

OTHER PUBLICATIONS

First Office Action and Search received for Chinese Patent Application No. 201910032384.8, dated Sep. 2, 2021, 14 pages. (English Translation Submitted).

*Primary Examiner* — Mark R Wendell

(74) *Attorney, Agent, or Firm* — Shook, Hardy & Bacon L.L.P.

(57) ABSTRACT

A mechanism is provided for a seating unit that moves the seating unit between closed, TV, and fully reclined positions. The mechanism allows independent movement of a seat frame, relative to the chair arms and chair back to which the mechanism is mounted. The mechanism thus allows the seat depth of the chair to be adjusted relative to the chair back to accommodate the individual characteristics of the chair occupant.

11 Claims, 25 Drawing Sheets

(56) References Cited

U.S. PATENT DOCUMENTS

| | | | | |
|---|---|---|---|---|
| 9,326,608 | B1 | 5/2016 | Hoy et al. | |
| 9,756,949 | B2 | 9/2017 | Huang et al. | |
| 2009/0039690 | A1 | 2/2009 | Simon et al. | |
| 2009/0256402 | A1* | 10/2009 | Smith | A47C 1/0352 297/69 |
| 2011/0175426 | A1 | 7/2011 | Lawson | |
| 2012/0049606 | A1 | 3/2012 | Lawson et al. | |
| 2012/0056462 | A1 | 3/2012 | Wong | |
| 2012/0286557 | A1 | 11/2012 | Hoffman et al. | |
| 2012/0299363 | A1 | 11/2012 | Crum | |
| 2013/0175847 | A1 | 7/2013 | Lawson | |
| 2015/0054315 | A1 | 2/2015 | Donovan et al. | |
| 2015/0289655 | A1 | 10/2015 | Lawson | |
| 2015/0320215 | A1 | 11/2015 | Flamme | |
| 2016/0045031 | A1 | 2/2016 | Lawson | |

FOREIGN PATENT DOCUMENTS

| | | | |
|---|---|---|---|
| CN | 105163627 | A | 12/2015 |
| WO | 2014/171838 | A1 | 10/2014 |

* cited by examiner

RECLINER SEATING MECHANISM WITH SEAT EXTENSION

CROSS-REFERENCE TO RELATED APPLICATIONS

This application is a continuation of co-pending U.S. patent application Ser. No. 16/244,700, filed Jan. 10, 2019, titled "Recliner Seating Mechanism with Seat Extension," which claims the benefit of U.S. Provisional Patent App. No. 62/616,864, filed Jan. 12, 2018, titled "Recliner Seating Mechanism with Seat Extension." These applications are incorporated herein by reference in the entirety.

TECHNICAL FIELD

Embodiments of the present invention relate to recliner seating mechanisms and chairs using them, and particularly to a recliner seating mechanism having a seat extension feature.

BACKGROUND OF THE INVENTION

In the motion furniture industry, mechanisms exist to move a chair between at least three positions: a closed position, with a footrest stowed and the chair back substantially upright; a TV or extended position, with the footrest extended and the back slightly reclined; and a fully reclined position, with the footrest extended and the back reclined. For certain people, chairs utilizing these mechanisms would find greater comfort if the seat of the chair was moveable, relative to the chair back and/or chair arms.

BRIEF DESCRIPTION OF THE INVENTION

A chair mechanism is provided that allows a chair seat to move relative to the chair back to adjust the depth of the seat. The chair mechanism allows the seat to be adjusted independently of the reclined position of the chair. The mechanism allows the chair to be adjusted between closed, TV, and fully reclined positions, whether the seat is in an extended position or not. The mechanism of the seating unit also drives a seat pitch change from the closed to the extended TV position, and from the extended TV position to the fully reclined position, increasing comfort for the chair occupant.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention generally relate to a chair mechanism that allows a chair seat to move relative to the chair back to adjust the depth of the seat. The chair mechanism allows the seat to be adjusted independently of the reclined position of the chair. The mechanism allows the chair to be adjusted between closed, TV, and fully reclined positions, whether the seat is in an extended position or not. The ottoman can thus be opened, and the mechanism reclined, at any point between the seat positions shown in FIGS. 1 and 2.

Figure 1:
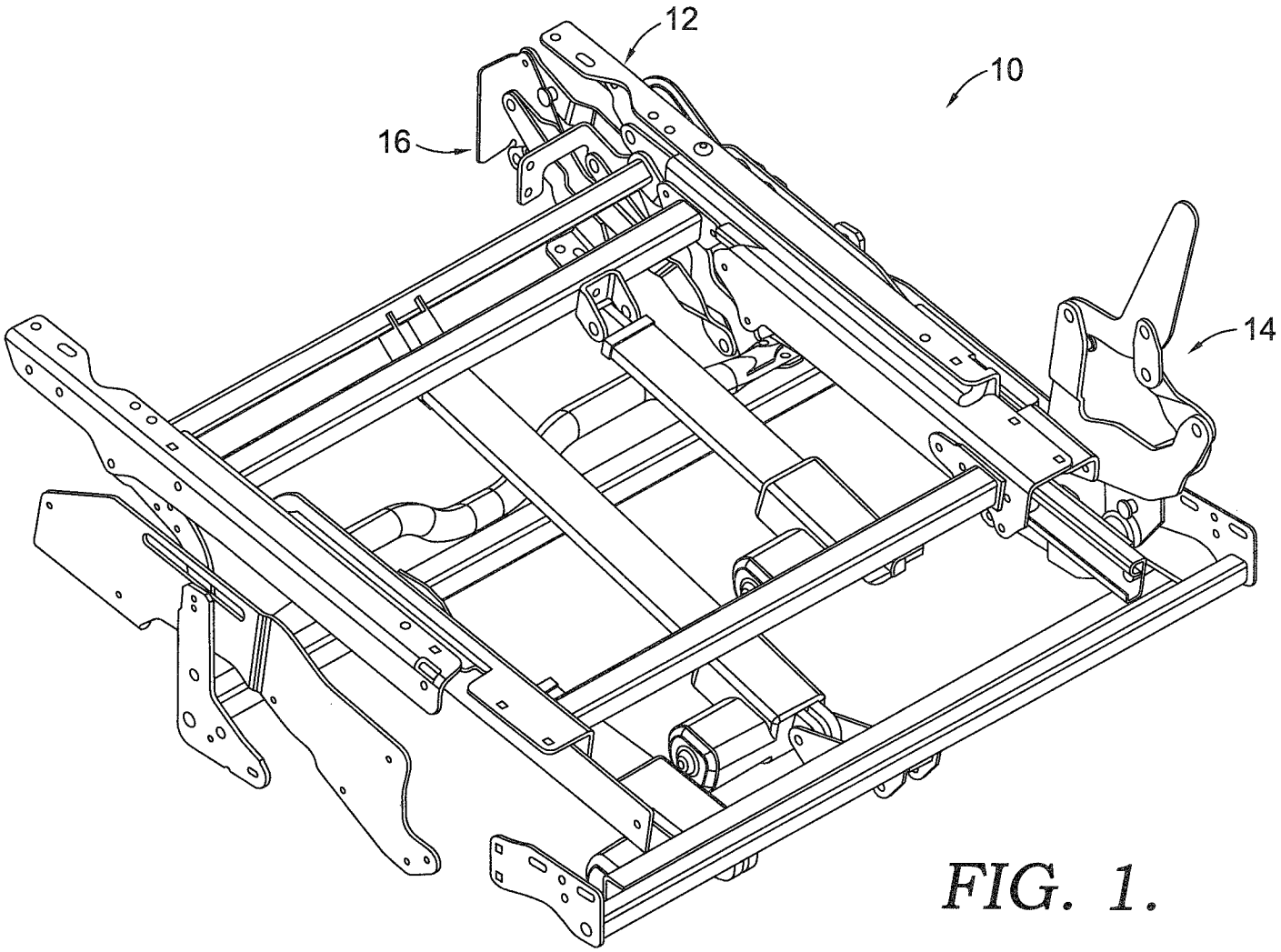
FIG. 1 is a perspective view of an exemplary chair mechanism in a closed position, with certain parts on the left-hand side removed, in accordance with an embodiment of the invention.
Figure 2:
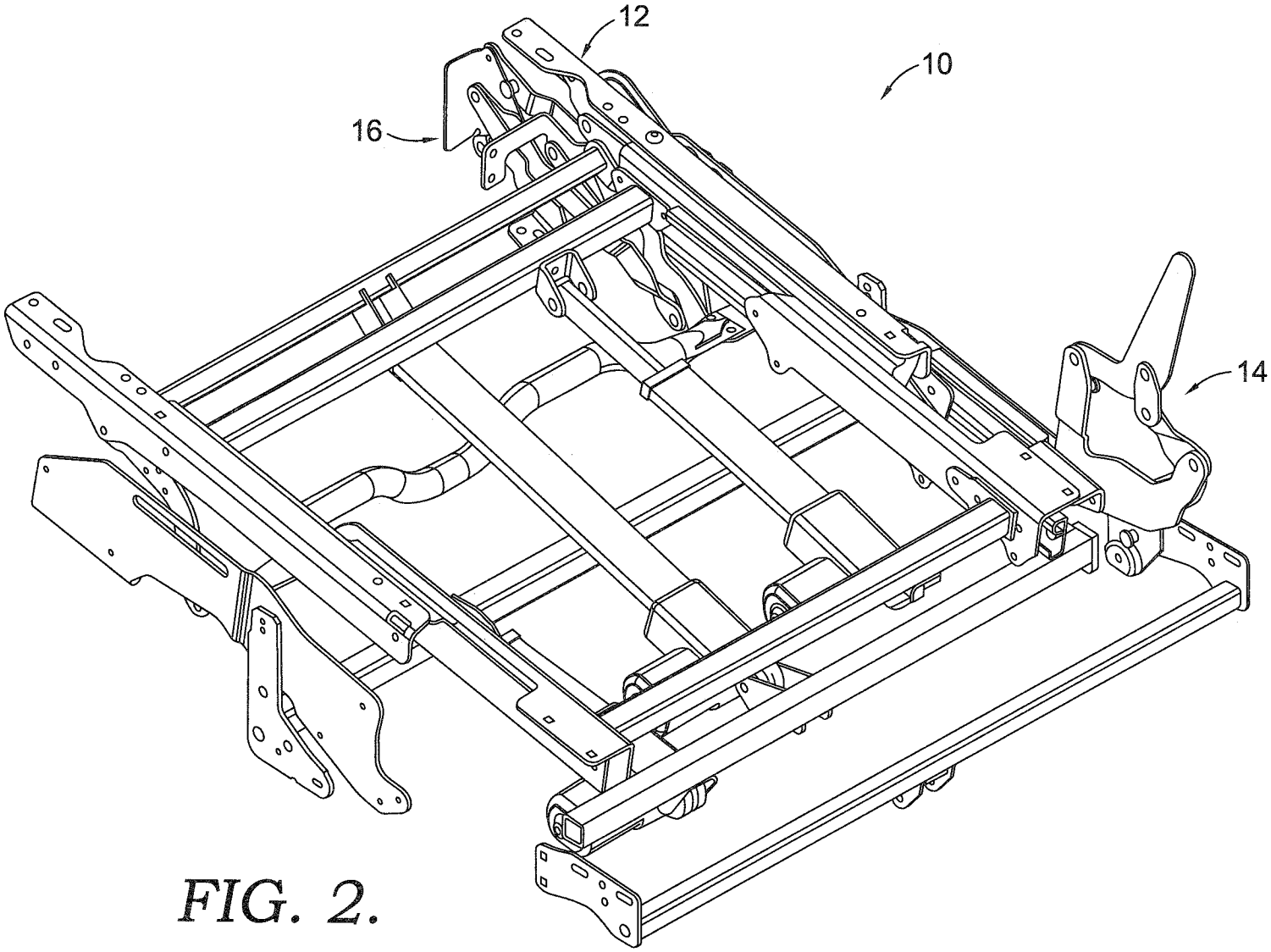
FIG. 2 is a view similar to FIG. 1, but showing the seat frame moved to an extended position.

A seating mechanism 10 is shown in a closed position in FIG. 1, with certain parts removed, for clarity. At a high-level, the mechanism 10 allows a seat frame 12 to be extended, relative to a back assembly 14, as shown in FIG. 2. Additionally, independently of the position of the seat frame 12, the mechanism 10 can move between the positions of FIG. 1 (closed), FIG. 3 (TV position with a footrest assembly 16 extended) and FIG. 4 (fully reclined back assembly 14 and extended footrest assembly 16).

Figure 9:
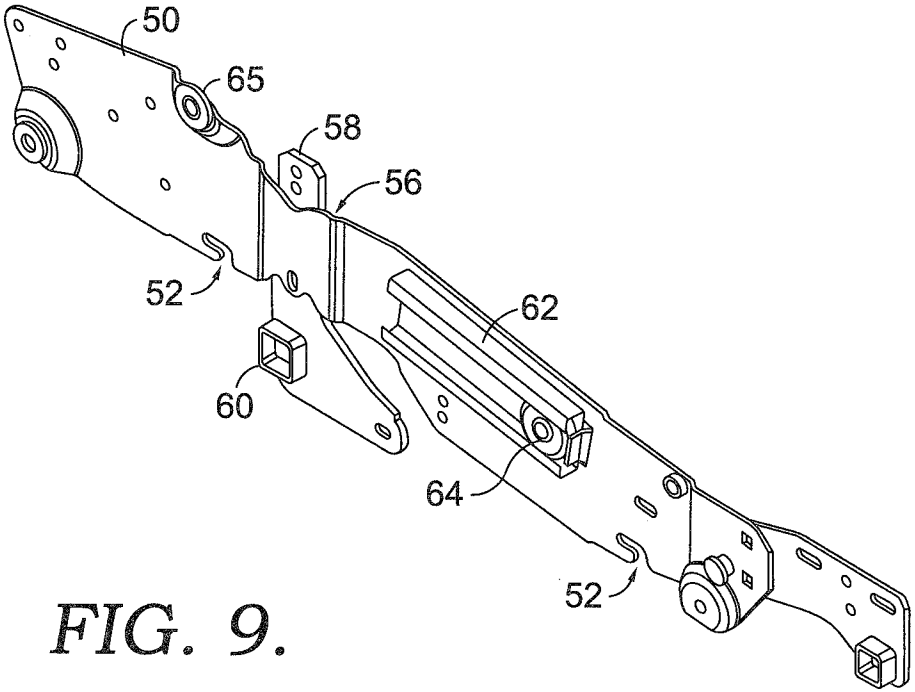
FIGS. 9-19 are cross-sections of FIG. 1, progressively moving from one side of the mechanism towards the opposite side, to show details of construction.

The mechanism 10 is described below with reference to the series of progressive cross-sections, beginning with FIG. 9. In some of the figures, partial links are shown, as a result of the perspective view. Mechanism 10 includes a base plate 50 that is used to attach the mechanism 10 to an arm of the finished chair. Base plate 50 may be attached to the chair arm in any number of ways, including the use of slots 52 provided in the bottom of base plate 50. Slots 52 allow easy installation of the mechanism 10 into a finished chair by dropping the mechanism 10 onto provided bolts or screws on a chair arm, through slots 52, and thereafter moving the mechanism rearwardly to the end of slots 52 and tightening the screws or bolts. Base plate 50 may be formed with an offset 56 that allows the base plate to be mounted to the chair arm and also allows an arm bracket 58 to be mounted to the chair arm as well. Arm bracket 58 is fixed to the chair arm. A support tube 60 is coupled to the arm bracket 58 and extends from one side of mechanism 10 to the other. Support tube 60 may be formed, for example, of square steel tubing. A roller track 62 is fixedly coupled to base plate 50. The roller track 62 supports a roller 64 that can roll within the roller track 62 from one end to the other. Base plate 50 also may have a reinforced coupling hub 65 formed therein.

Figure 10:
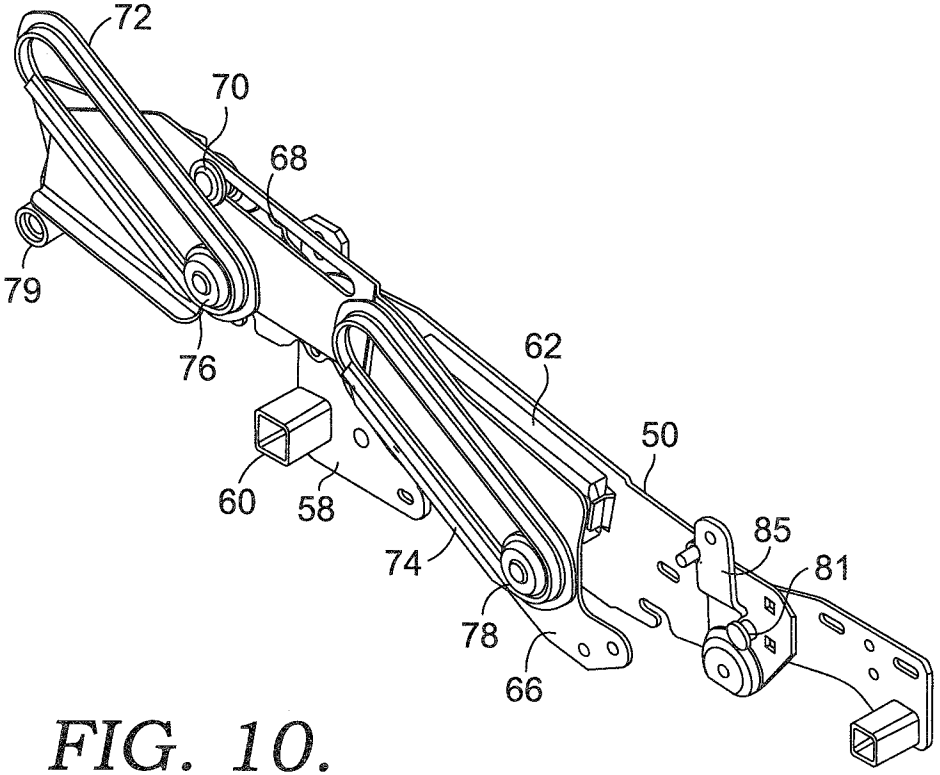

As best seen in FIG. 10, a carrier plate 66 is coupled to the base plate 50. More specifically, the rearward end of carrier plate 66 is coupled to roller 64, which is held within roller track 62. The forward end of carrier plate 66 has an elongated slot 68 formed therein. A roller 70 is coupled to the hub 65 in base plate 50. The roller 70 and the roller 64 allow the carrier plate 66 to move relative to the base plate 50. A front roller track 72 and a rear roller track 74 are fixedly coupled to carrier plate 66 in an inclined orientation, as seen in FIG. 10. A front roller 76 is held within front roller track 72, and a rear roller 78 (partially shown in FIG. 10) is held within rear roller track 74. The lower side of the front of carrier plate 66 is further supported by a cylindrical post 79 that is fixedly coupled to base plate 50. FIG. 10 also shows a toggle link 85 that is part of the back assembly 14 and that is pivotably coupled to base plate 50. Toggle link 85 is prevented from over-rotation by a stop 81 that extends from base plate 50.

Figure 11:
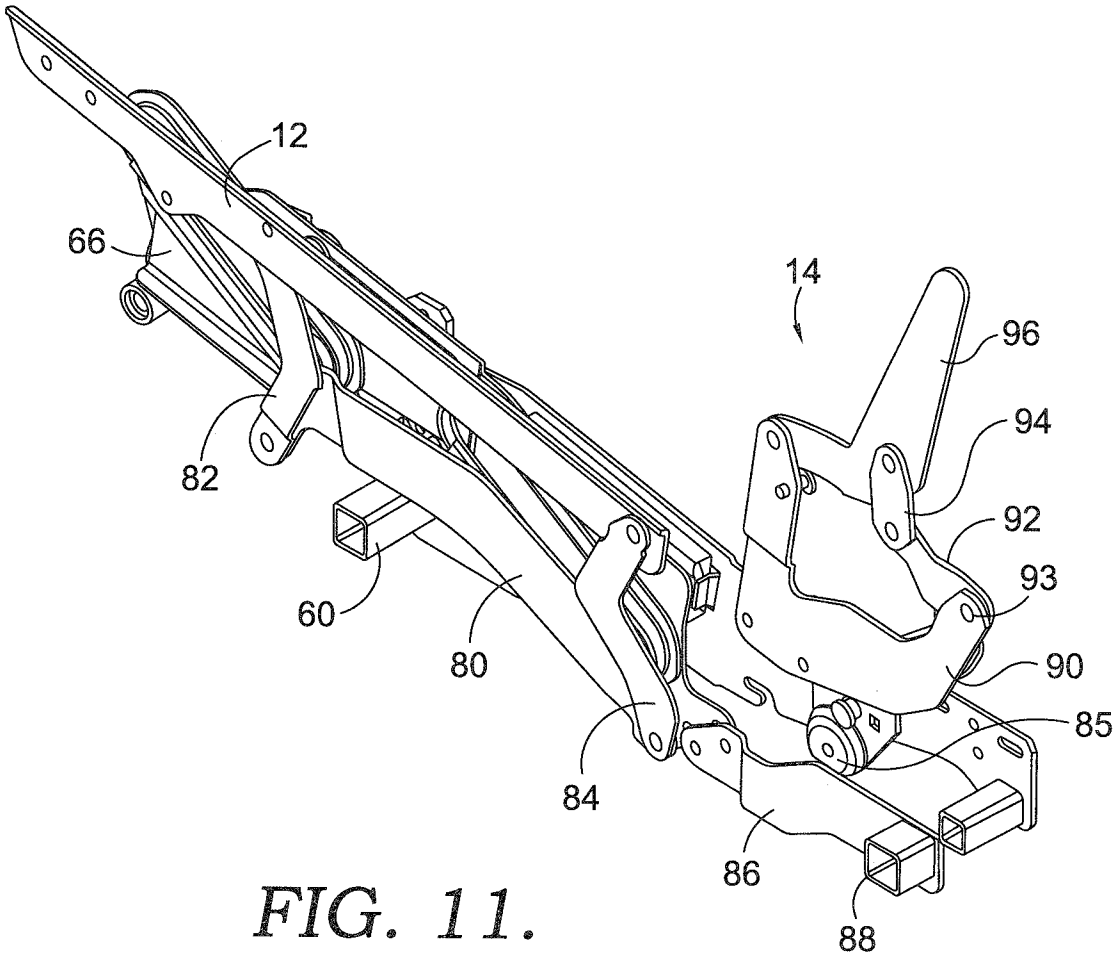

As seen in FIG. 11, a trolley 80 is coupled on its front end to front roller 76, and is coupled on its back end to rear roller 78, such that the trolley moves with the rollers 76 and 78. The lower front end of the trolley 80 is pivotably coupled to a front pivot link 82 that extends upwardly. The upper end of the front pivot link 82 is pivotably coupled to seat frame 12. The lower rear end of trolley 80 is pivotably coupled to a rear pivot link 84 that also extends upwardly. The upper end of rear pivot link 84 is pivotably coupled to seat frame 12. FIG. 11 also shows a motor tube end bracket 86 that is fixedly coupled to carrier plate 66, and extends rearwardly therefrom. A portion of a rear motor tube 88 is shown in FIG. 11 that is fixedly coupled to the motor tube end bracket 86. In a preferred aspect, motor tube 88 is made of square steel tubing, but other materials could also be used.

Figure 4:
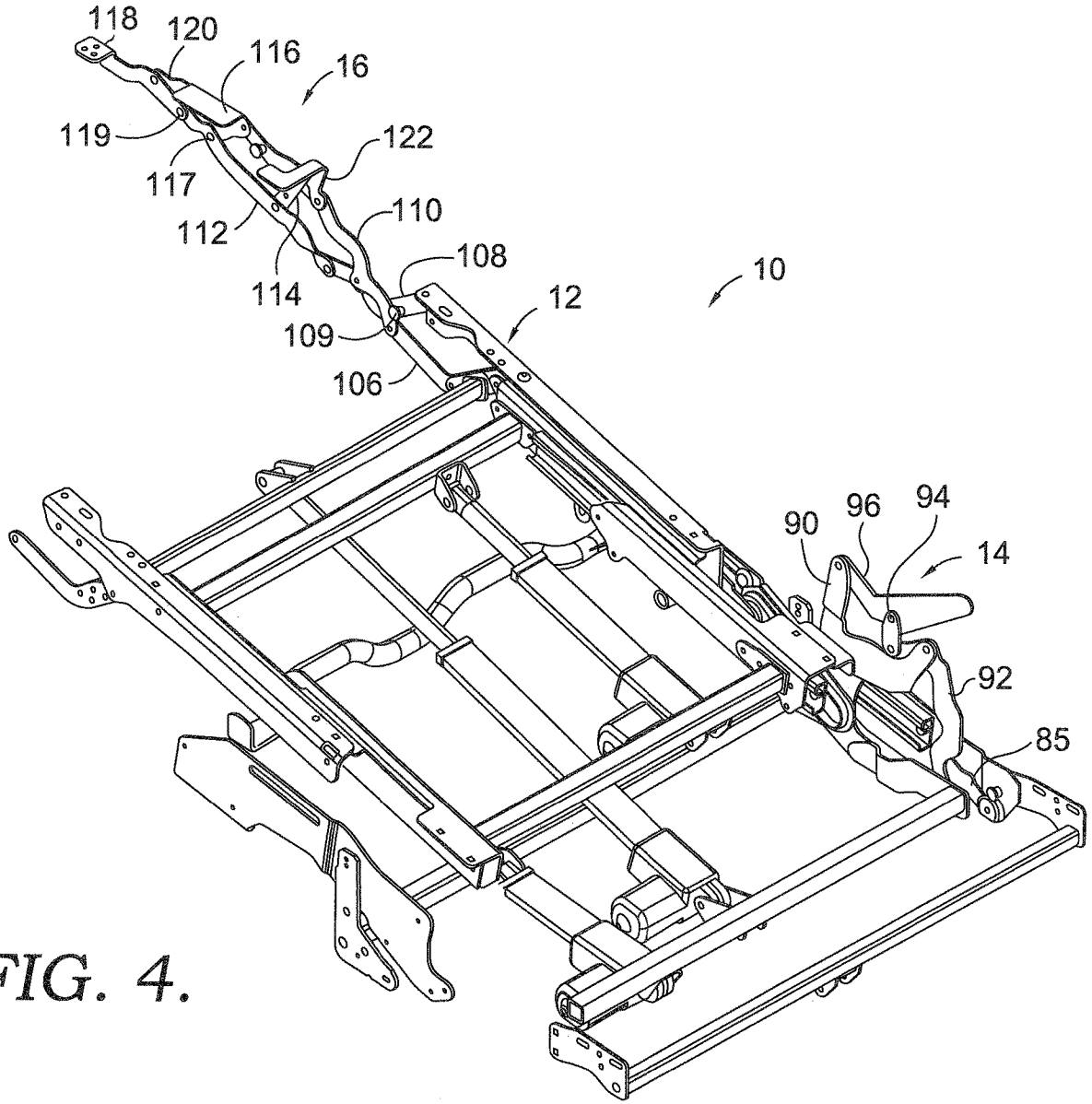
FIG. 4 is a view similar to FIG. 3, but showing the mechanism in the fully reclined position.
Figure 5:
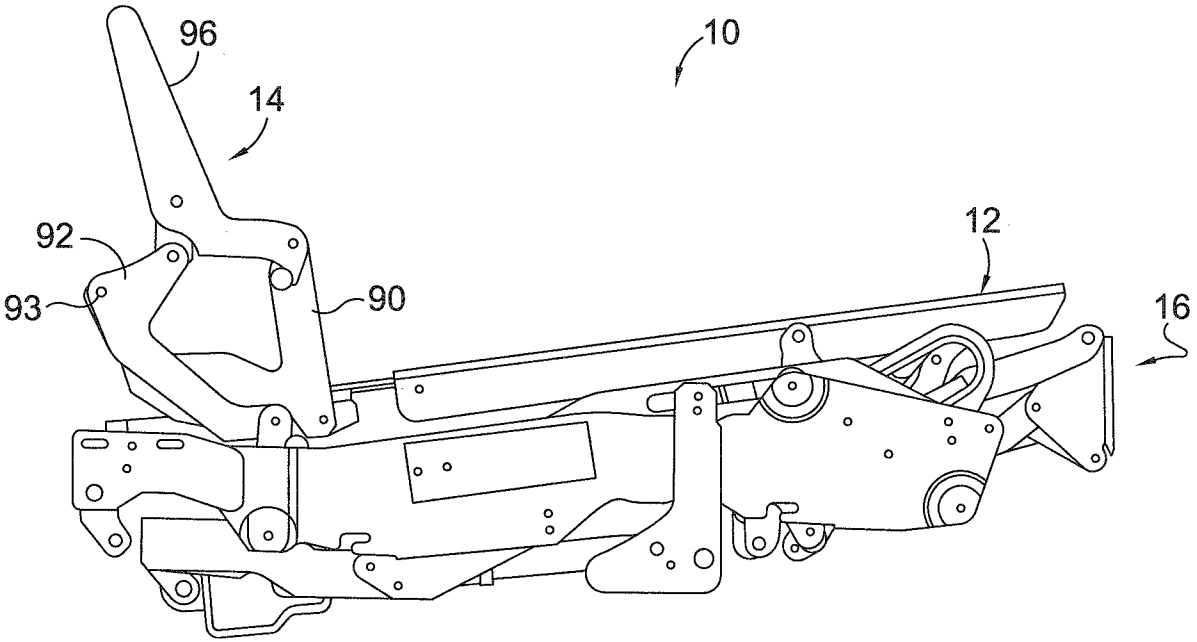
FIG. 5 is a side elevation view of FIG. 1.
Figure 6:
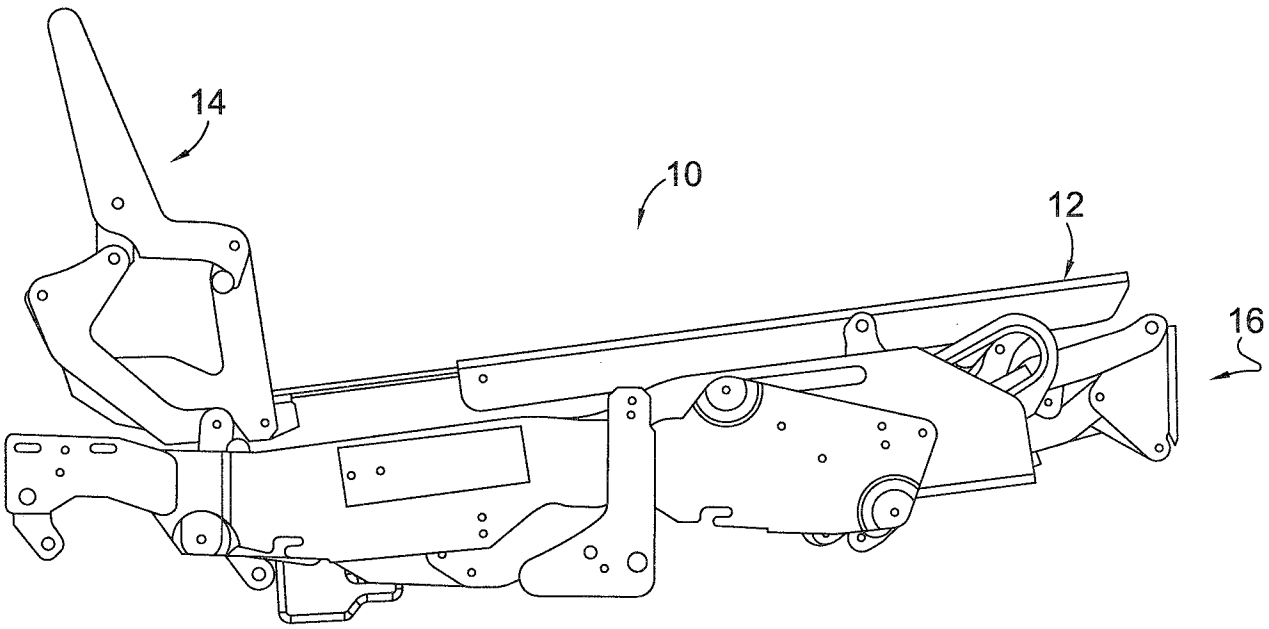
FIG. 6 is a side elevation view of FIG. 2.

Back assembly 14 is also shown more fully in FIG. 11, with a rear bell crank 92 (as best seen in FIGS. 4 and 5) that is pivotably coupled on its lower end to the upper end of toggle link 85. With reference to FIGS. 5 and 11, near the upper end of rear bell crank 92, a rear leg of a rear seat bracket 90 is pivotably coupled to the rear bell crank 92 at pivot point 93. The upper end of rear bell crank 92 is pivotably coupled to a lower end of a back drive link 94. The upper end of the back drive link 94 is pivotably coupled to a lower, rear area of a back mounting link 96. The back mounting link 96 is configured to mount a back of a chair to the mechanism 10. The lower front leg of back mounting link 96 is pivotably coupled to a front leg of the rear seat bracket 90.

Figure 7:
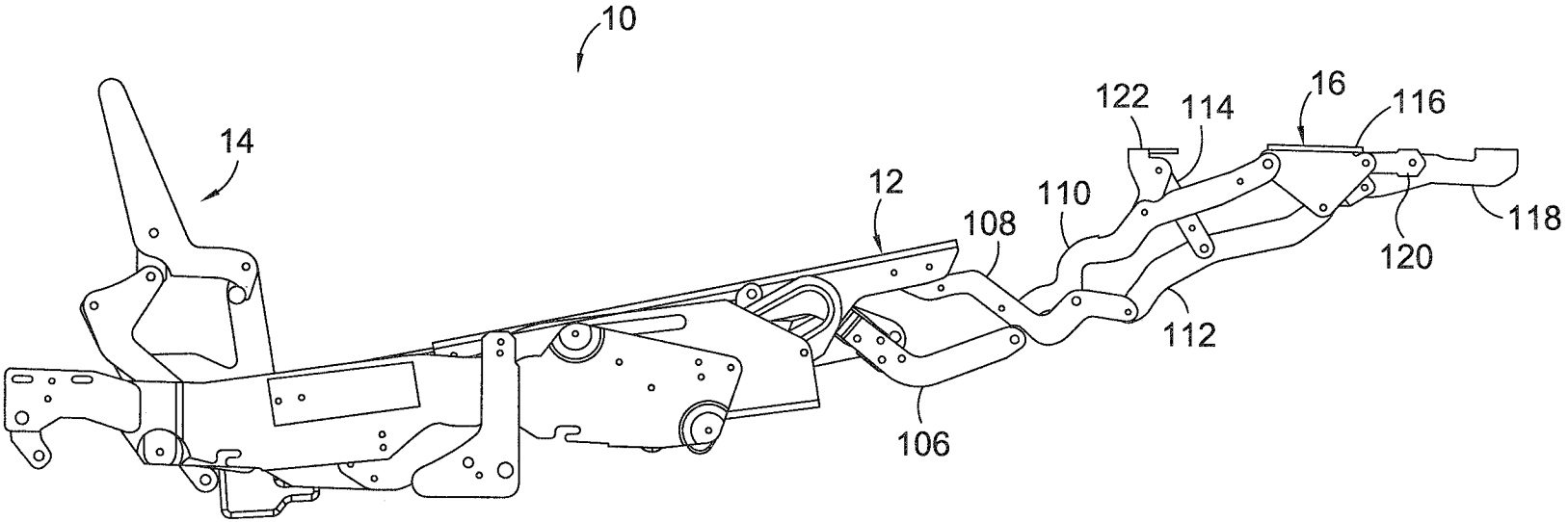
FIG. 7 is a side elevation view of FIG. 3.
Figure 8:
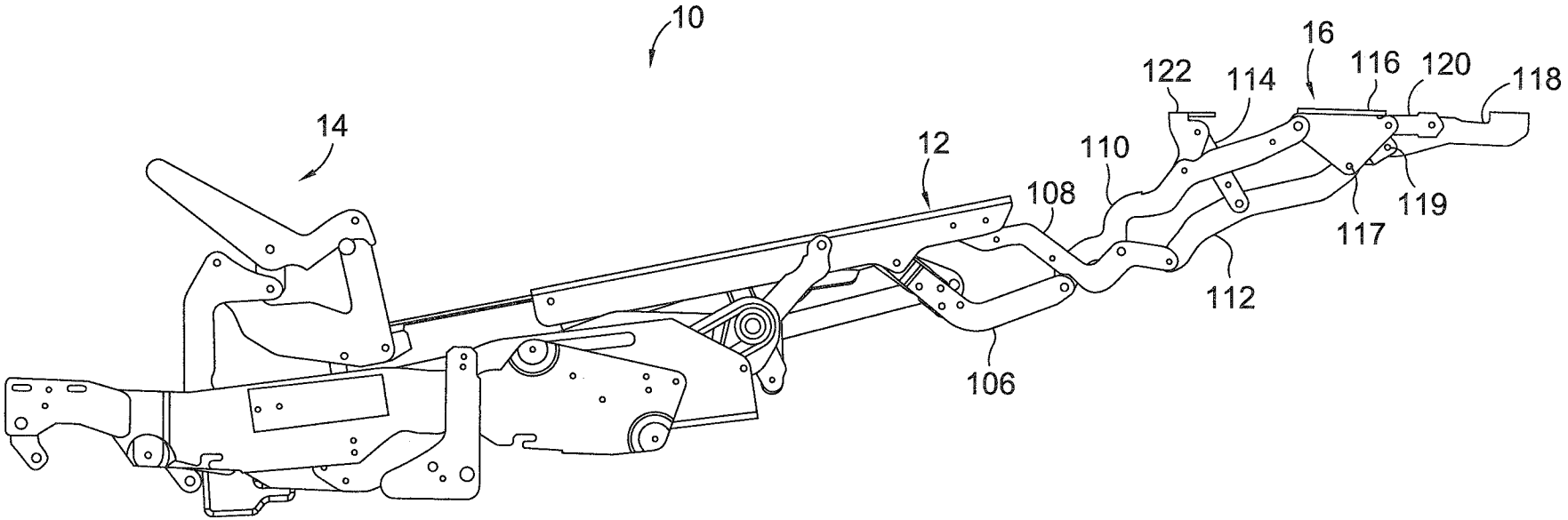
FIG. 8 is a side elevation view of FIG. 4.
Figure 12:
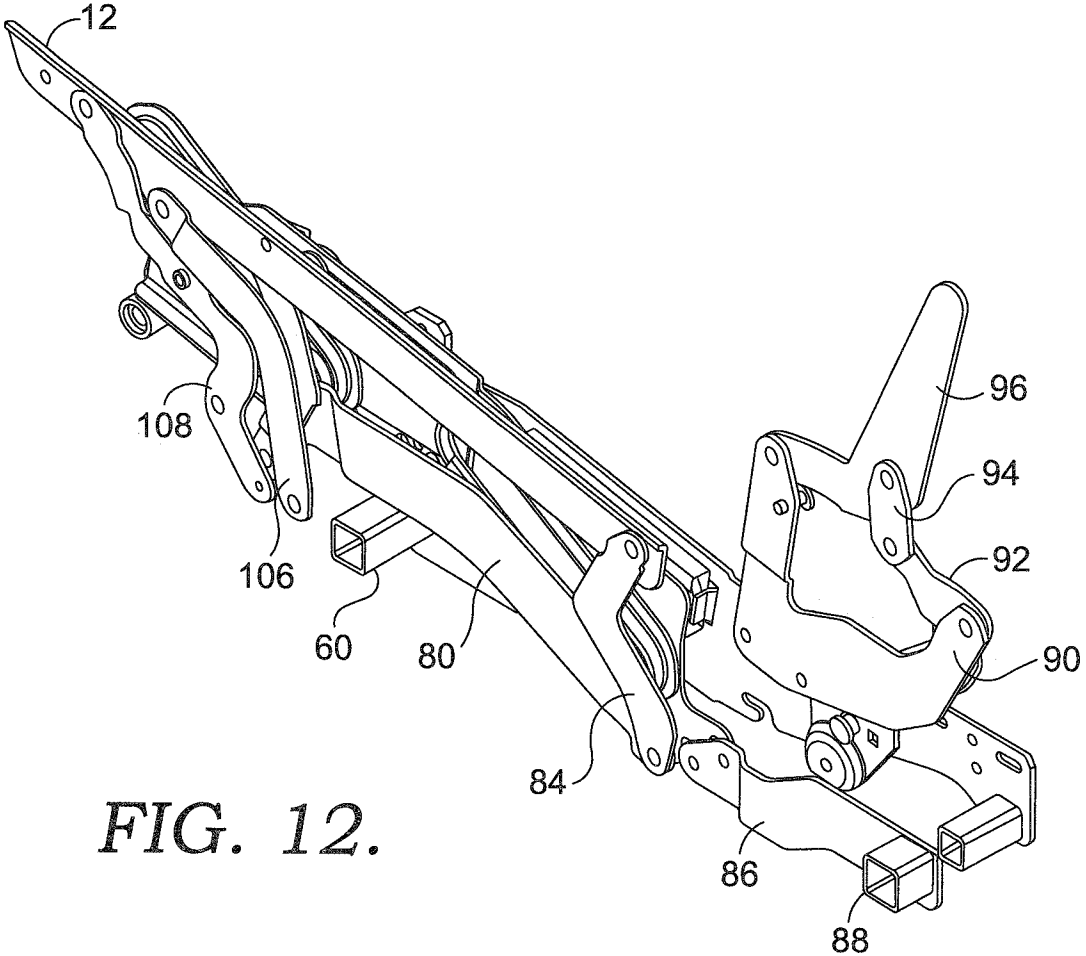
Figure 22:
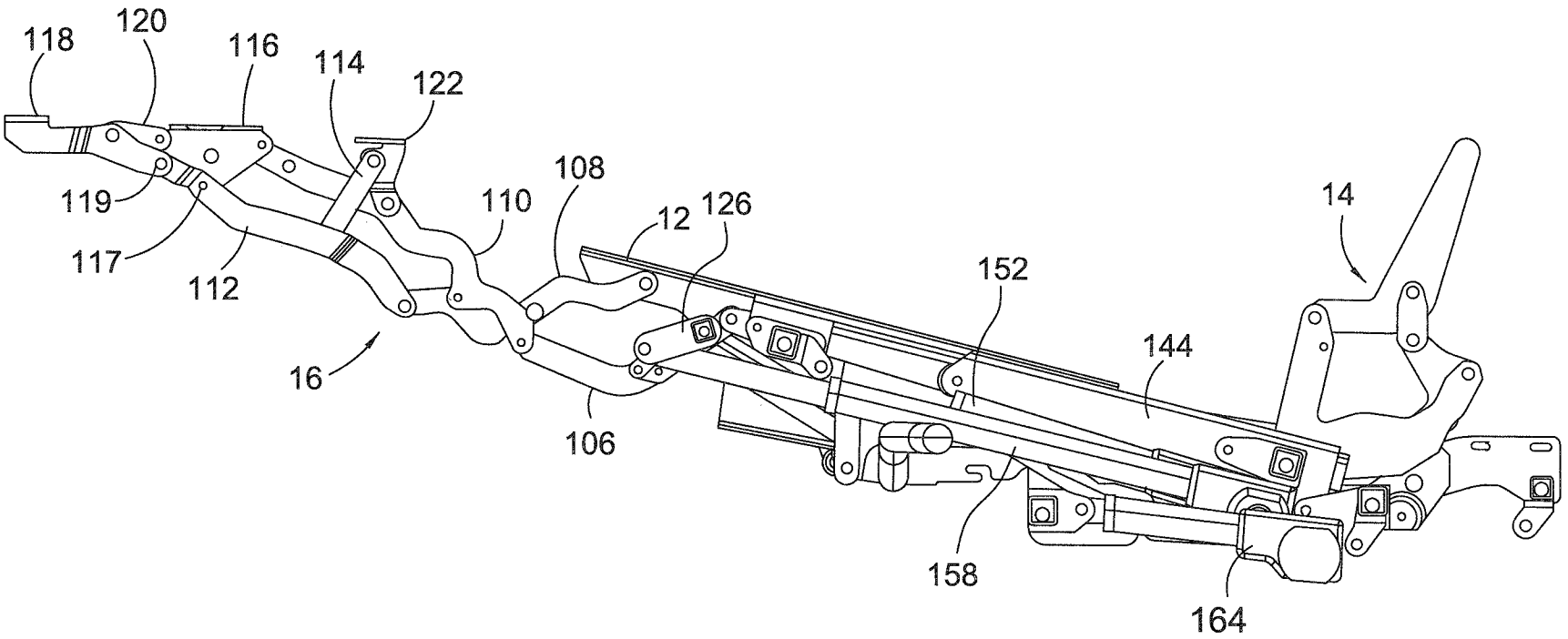
FIG. 22 is a side view of the cross-section of FIG. 21.

FIG. 12 shows a rear ottoman link 106 that is pivotably coupled on its upper end to the seat frame 12. As best seen in FIGS. 4 and 8, the lower end of rear ottoman link 106 is pivotably coupled to a main ottoman link 110. The main ottoman link 110 is pivotably coupled to a front ottoman link 108 between its two ends. The front ottoman link 108 is pivotably coupled on its upper end to the seat frame 12, as best seen in FIG. 12. As best seen in FIG. 4, the front ottoman link 108 has a stop 109 fixedly coupled thereto that prevents the footrest assembly 16 from extending beyond the fully extended position of FIGS. 3 and 4. As best seen in FIG. 7, the lower or front end of front ottoman link 108 is pivotably coupled to a second ottoman link 112. Front ottoman link 108 is thus pivotably coupled to seat frame 12, main ottoman link 110, and second ottoman link 112. As best seen in FIG. 22, the second ottoman link 112 is pivotably coupled to a mid-ottoman control link 114 generally midway along the second ottoman link 112. The upper end of second ottoman link 112 is pivotably coupled to a footrest bracket 116 at pivot 117 and to a flipper ottoman bracket 118 at pivot 119. The flipper ottoman bracket 118 is also pivotably coupled to a flipper control link 120. The opposite end of flipper control link 120 is pivotably coupled to the footrest bracket 116. The mid-ottoman control link 114 is pivotably coupled on its upper end to a mid-ottoman bracket 122 that is also pivotably coupled to the main ottoman link 110.

Figure 12A:
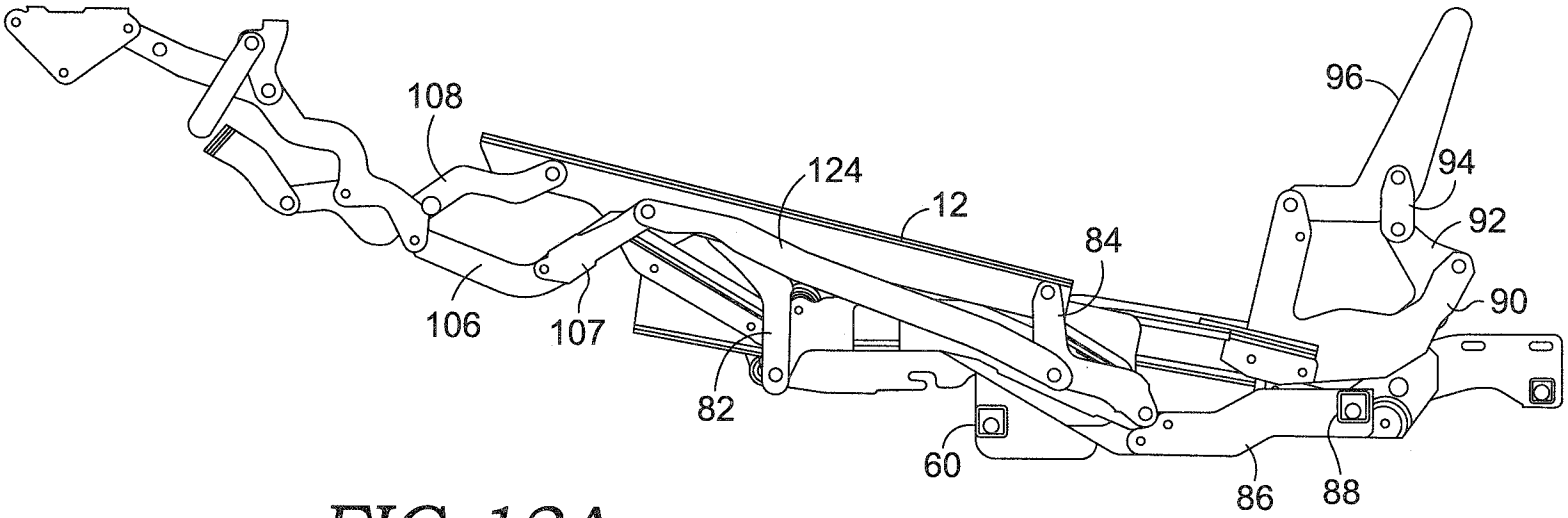
FIG. 12A is a side view of a cross-section taken between the views of FIGS. 12 and 13, with the mechanism in a TV position, to show a secondary rear ottoman link hidden from view in many of the FIGS.
Figure 13:
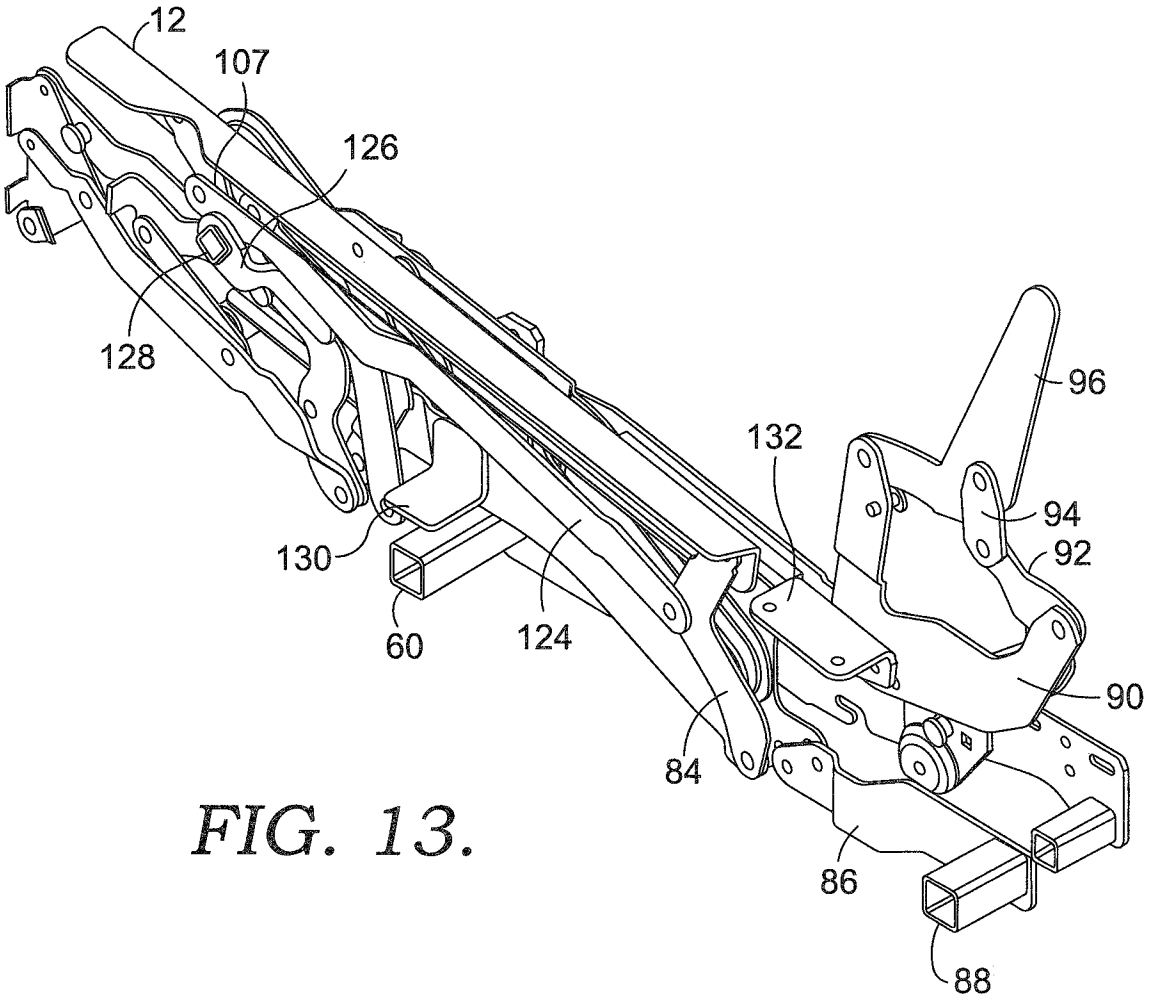

FIG. 12A is a side view of a cross-section taken between the views shown in FIGS. 12 and 13, with the mechanism 10 in the TV position. In this view, a secondary rear ottoman link 107 is shown. The lower end of secondary rear ottoman link 107 is fixedly coupled to rear ottoman link 106. The upper end of secondary rear ottoman link 107 is pivotably coupled to a footrest drive link 124 as best seen in FIGS. 12A and 13. The footrest drive link 124 extends rearwardly and is pivotably coupled on its other end to rear pivot link 84, generally around the mid-point of rear pivot link 84. As best seen in FIG. 13, an ottoman drive tube bracket 126 is fixedly coupled to the lower end of secondary rear ottoman link 107. Ottoman drive tube bracket 126 has an offset or bend mid-way along its length and is coupled to ottoman drive tube 128 that extends from one side of the mechanism to the other. As with other drive tubes, ottoman drive tube 128 is made of square steel tubing, but other materials could also be used. FIG. 13 also shows a bracket 130 that is coupled to the trolley 80. Additionally, FIG. 13 shows a bracket 132 that is fixedly coupled to the rear seat bracket 90 and extends inwardly therefrom.

Figure 14:
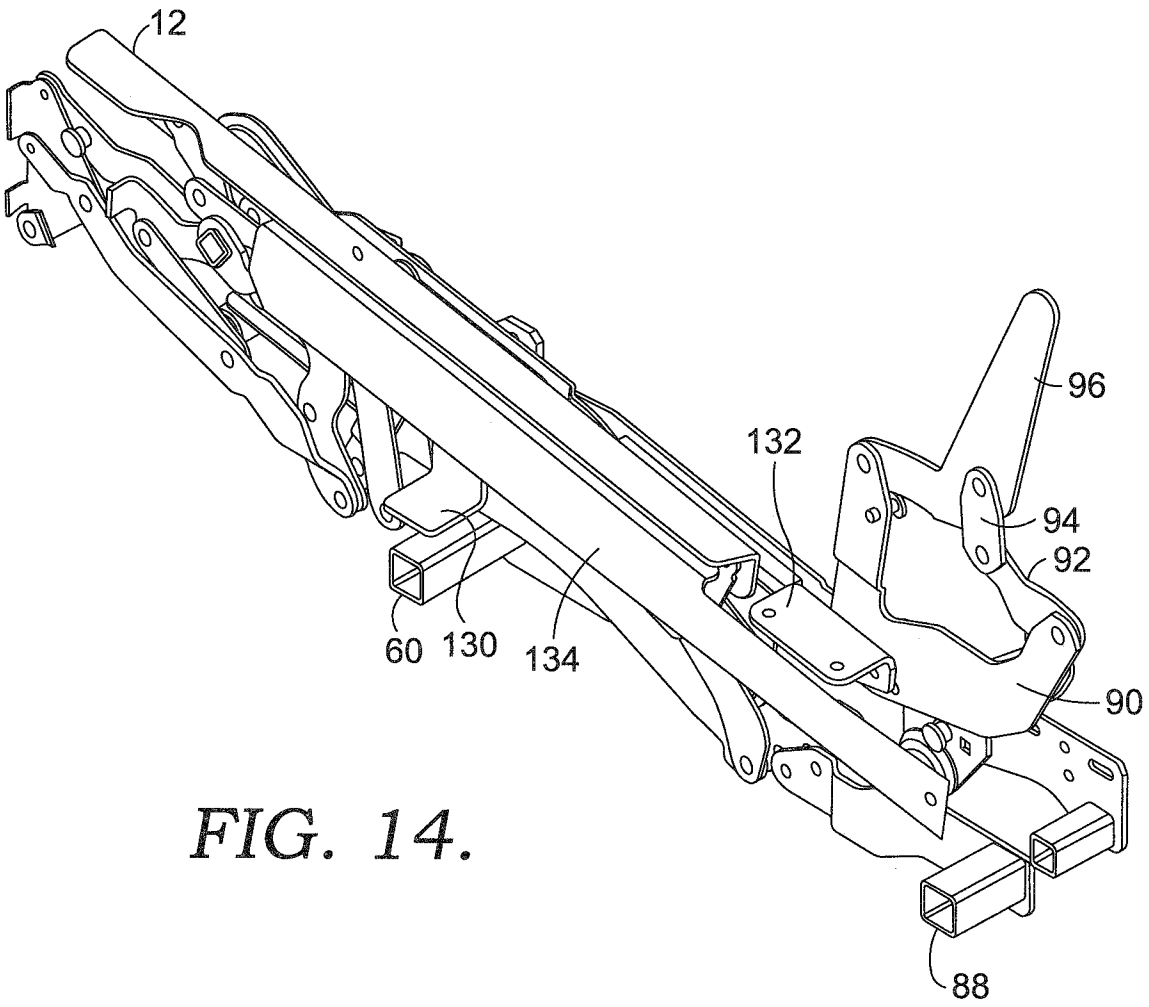
Figure 15:
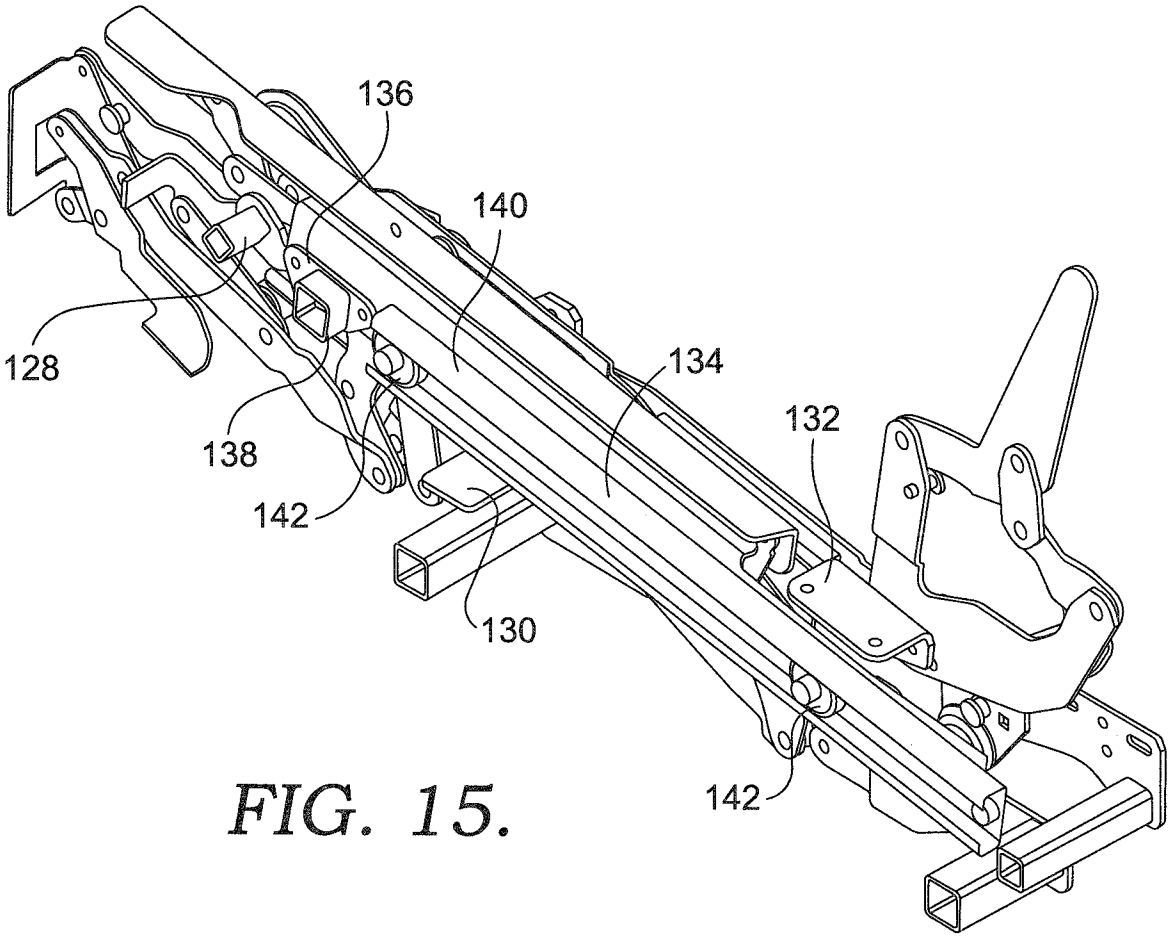
Figure 16:
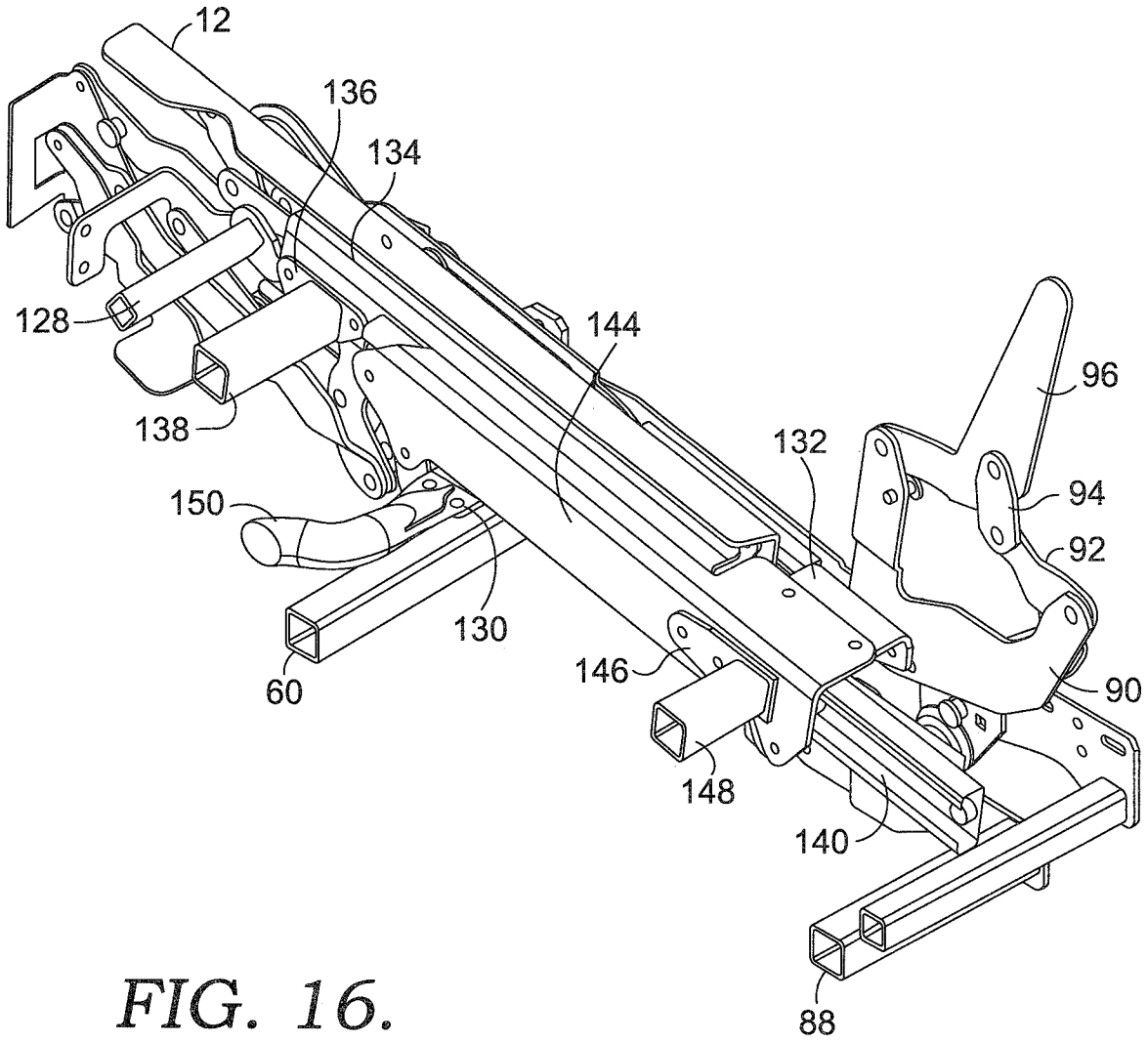
Figure 21:
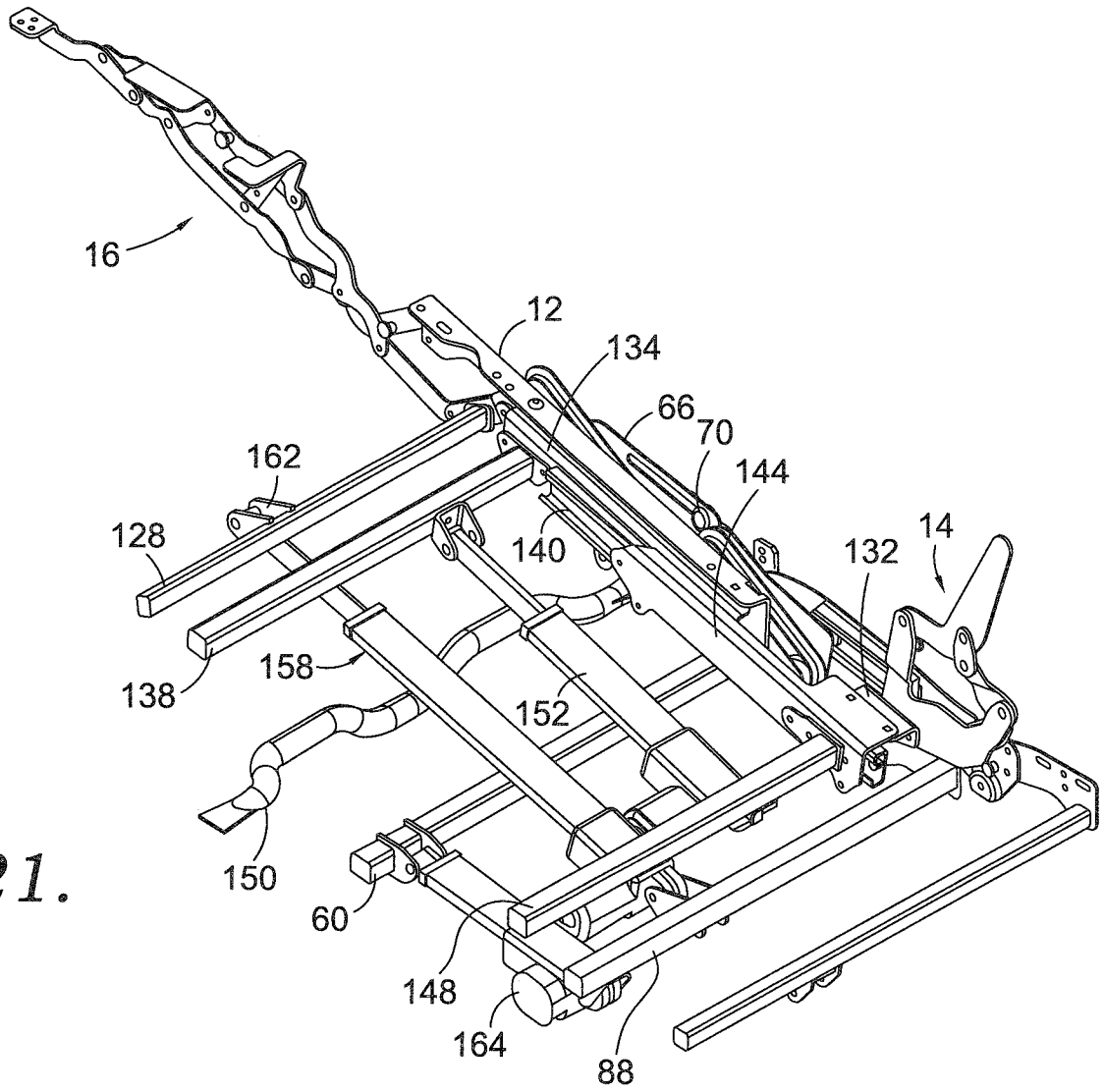
FIG. 21 is a view similar to FIG. 20, but showing the mechanism in a TV position.
Figure 23:
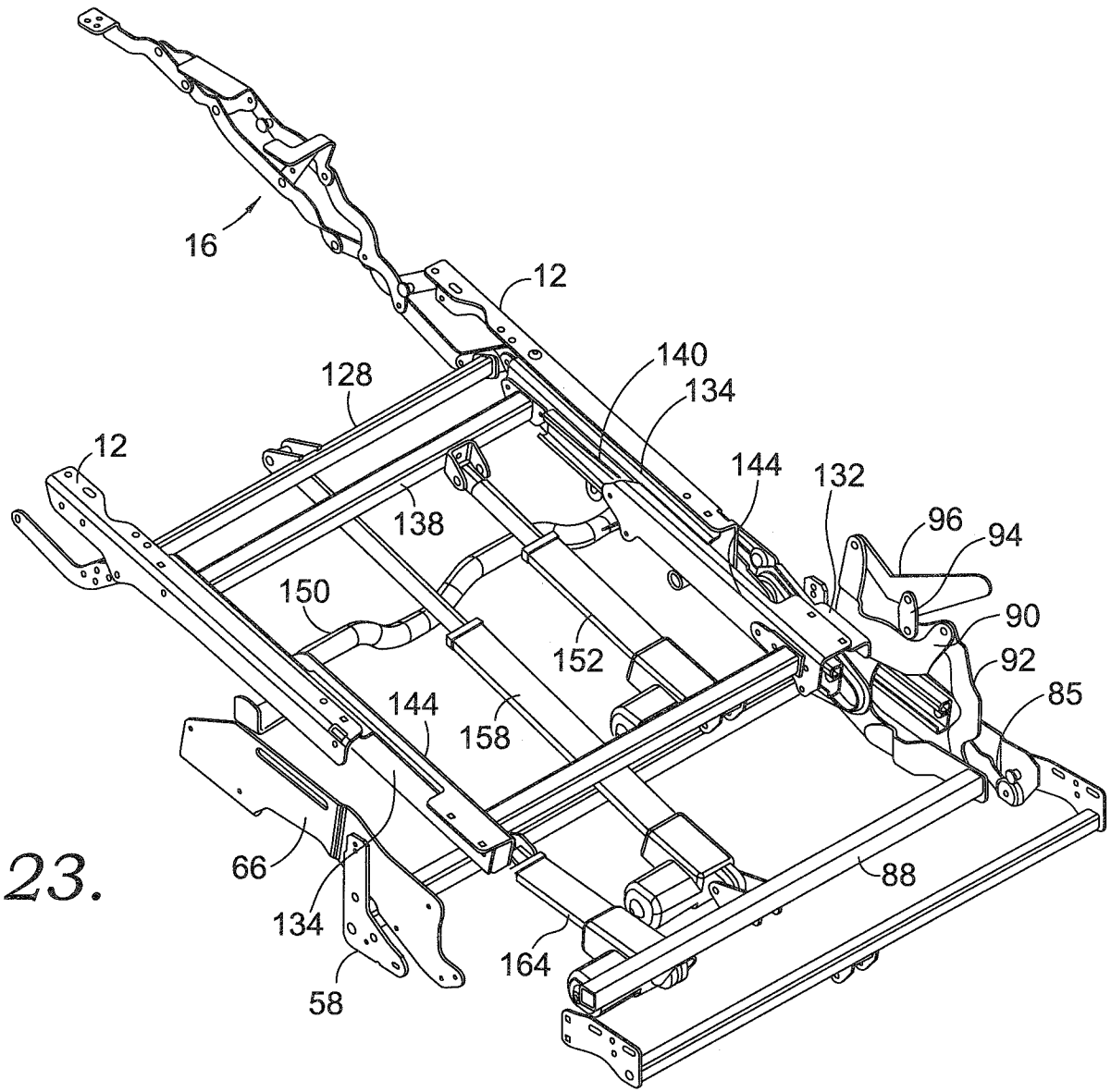
FIG. 23 is a view similar to 20, but showing the mechanism in a fully reclined position.
Figure 24:
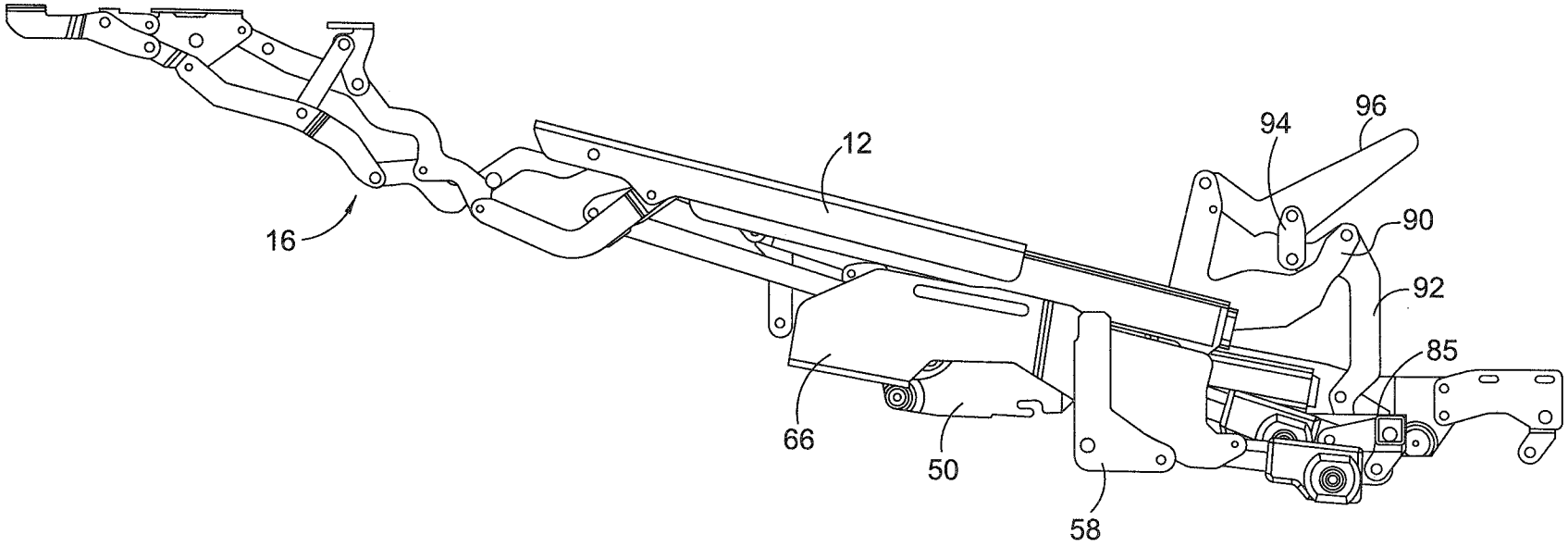
FIG. 24 is a side view of the cross-section of FIG. 23.

As shown in FIG. 14, a seat frame extension 134 is fixedly coupled to the seat frame 12. Seat frame extension 134 has a top flange that is secured to the seat frame 12, such as with bolts, rivets, or welds. A vertical flange extends from the top flange of seat frame extension 134. This vertical flange also extends further rearwardly than does the seat frame 12. As shown in FIG. 15, a front motor tube bracket 136 is fixedly coupled to the vertical flange of the seat frame extension 134. A front motor tube 138 is fixedly coupled to the front motor tube bracket 136, and extends from one side of mechanism 10 to the other. A roller track 140 is also fixedly coupled to the vertical flange of seat frame extension 134. As seen in FIG. 15, a pair of rollers 142 is held within roller track 140 and roll along and within the roller track 140. As best seen in FIG. 16, a roller support bracket 144 is fixedly coupled to bracket 132 and extends inwardly therefrom. The rollers 142 are pivotably coupled to the roller support bracket 144, such that the roller support bracket 144 moves with the rollers 142. FIG. 16 also shows a motor tube bracket 146 that is fixedly coupled to the roller support bracket 144. The motor tube bracket 146 supports a motor tube 148 that is fixedly coupled to the motor tube bracket 146 and that extends from one side of mechanism 10 to the other. A terminal end of a support tube 150 is shown in FIG. 16 that is fixedly coupled to bracket 130. As best seen in FIG. 21 or 23, the support tube 150 extends from one side of mechanism 10 to the other, and may be formed with bends therein to provide clearance for other components of the mechanism 10.

Figure 17:
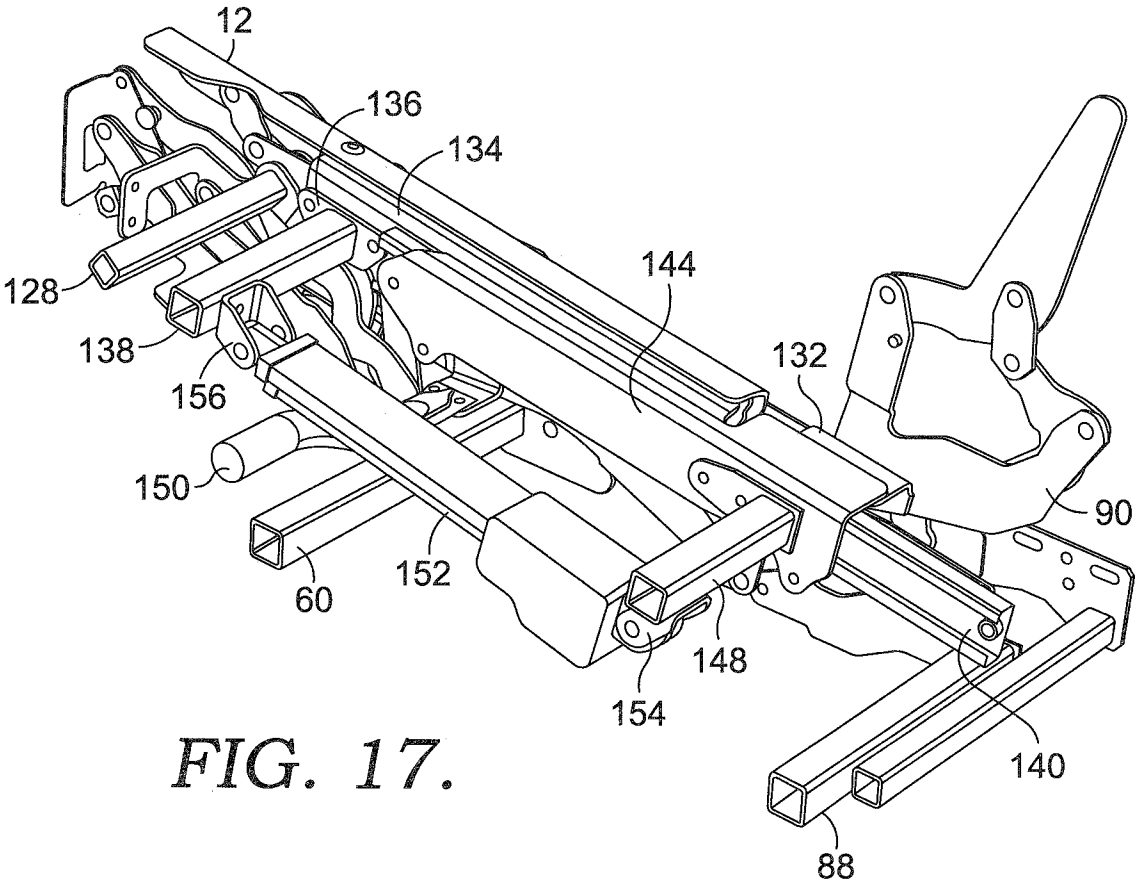
Figure 18:
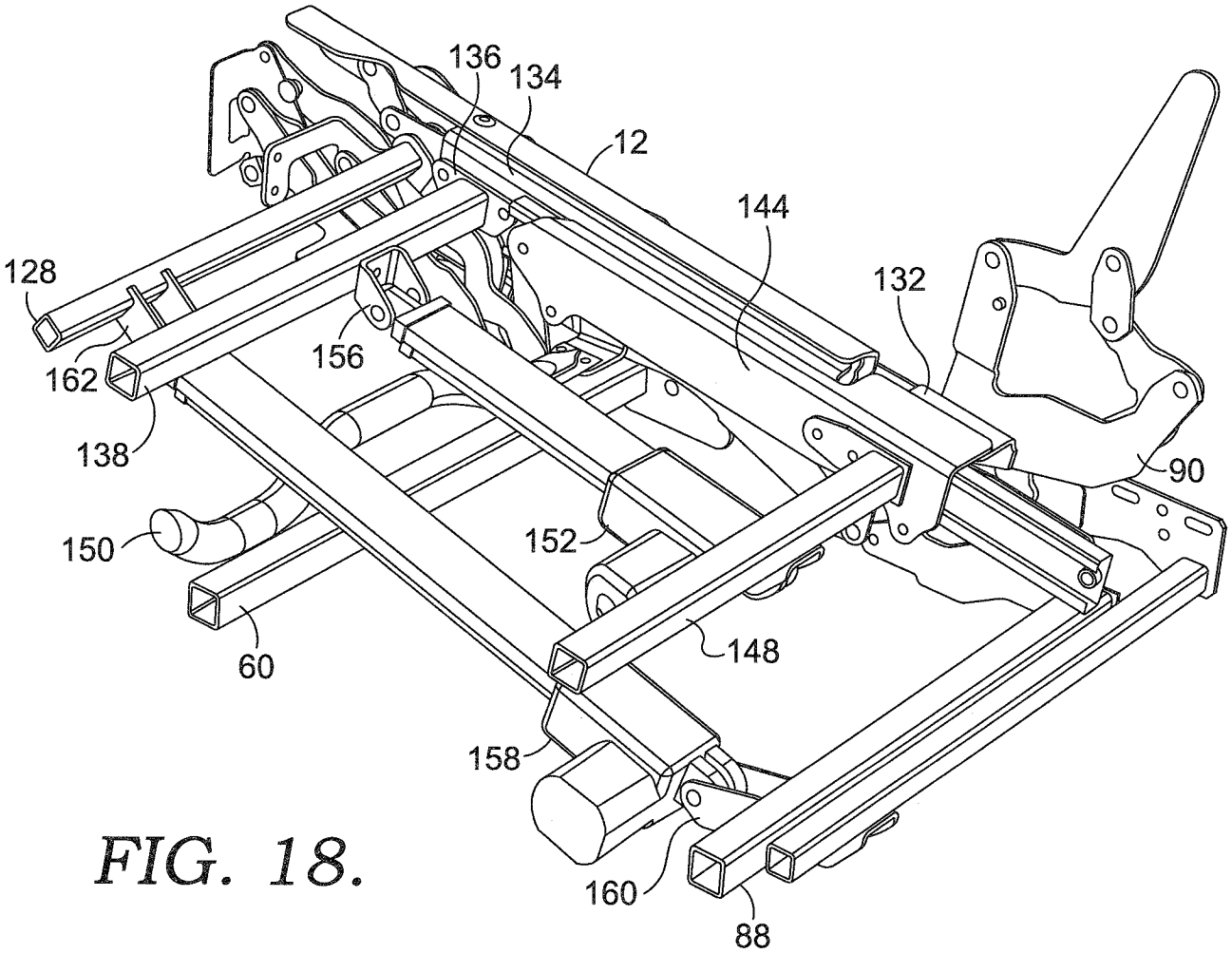
Figure 19:
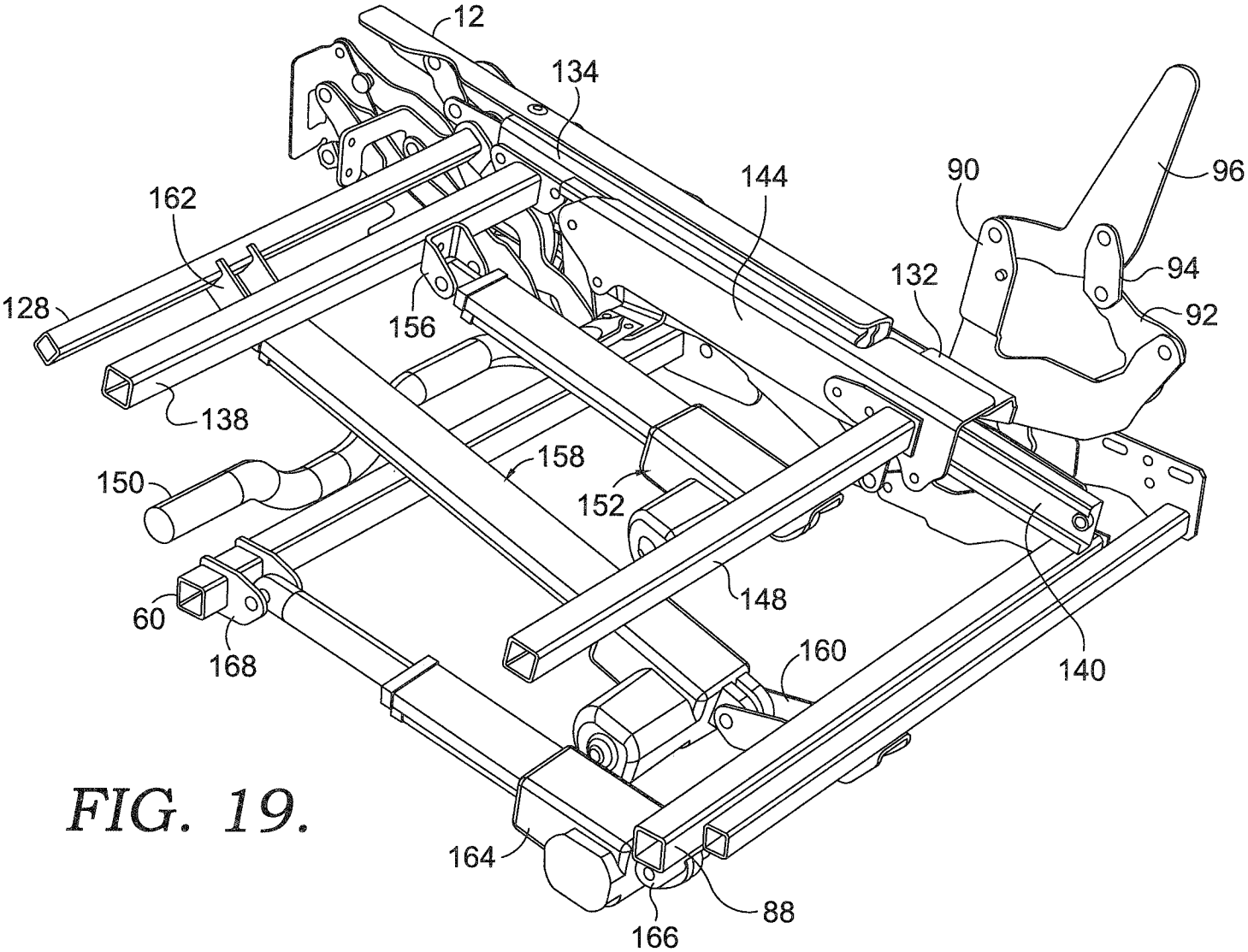
Figure 20:
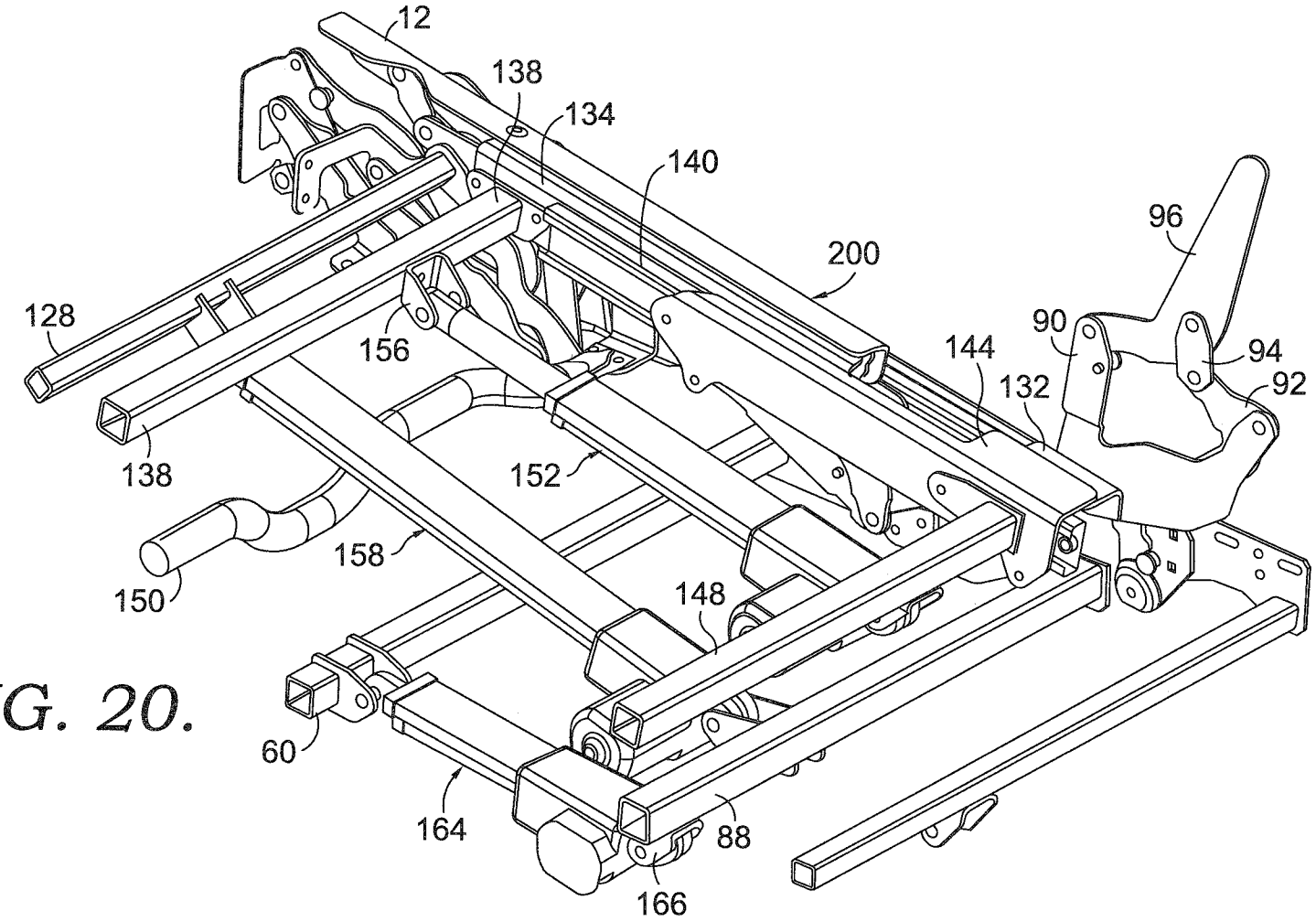
FIG. 20 is a view similar to FIG. 19, but showing the seat in an extended position.

As best seen in FIG. 17, a front motor 152 is pivotably coupled on a rear end through a clevis 154 to motor tube 148. The extendable shaft of front motor 152 is pivotably coupled through a clevis 156 to front motor tube 138. FIG. 18 shows an ottoman drive motor 158 that is pivotably coupled on a rear end through a clevis 160 to rear motor tube 88. The extendable shaft of ottoman drive motor 158 is pivotably coupled through a clevis 162 to ottoman drive tube 128. As seen in FIG. 19, a motor 164 is pivotably coupled through a clevis 166 to motor tube 88. The extendable shaft of motor 164 is pivotably coupled to support tube 60 through a clevis 168. Each of the motors is connected to a power source (not shown for simplicity) and to operational controls on the chair, such as a toggle to move the chair from the closed position, to the TV position, or fully reclined position (or from the fully reclined position back to the TV position and finally to the closed position). Together, the carrier plate 66, seat frame 12 and roller track 140 make up at least a portion of a seat frame assembly 200, as best seen in FIG. 20.

In operation, the seat frame 12 can be adjusted forwardly, independently of the chair arms, and the chair back. FIG. 19 shows the seat frame in a rearward position, and FIG. 20 shows the seat frame adjusted to a forward position. The seat frame 12 is adjustable in any location between the rearward position and the forward position. To adjust the seat frame 12 forward, motor 164 is engaged to pull rear motor tube 88 forward, anchored by support tube 60, which is attached to the chair arms by arm brackets 58. Rear motor tube 88 is connected to motor tube end bracket 86, which is, in turn, connected to carrier plate 66. Thus, as motor 164 is engaged, carrier plate 66 is driven forward, guided by front roller 70 in slot 68 and roller 64 in roller track 62. The front motor 152 is synchronized with motor 164, such that the extendable shaft of front motor 152 extends as the shaft of motor 164 retracts. As the shaft of front motor 152 extends, it moves front motor tube 138 forward. Because front motor tube 138 is connected to seat frame extension 134, this also moves seat frame extension 134 forward guided by rollers 142 in roller track 140. This motion moves seat frame 12 forward because the seat frame 12 is connected to seat frame extension 134. The front motor 152 is anchored at the rear by motor tube 148, which is attached to rear seat bracket 90 by roller support bracket 144 and bracket 132. As can be seen by comparing FIGS. 19 and 20, synchronized operation of motors 152 and 164 operates to move seat frame 12 forward (or backward) without moving the back assembly 14. This allows independent adjustment of the seat depth of a chair having mechanism 10.

The mechanism 10 can move from the closed position to the TV position with the seat frame 12 in any position, from the most rearward position (FIG. 1) to the seat frame 12 forward-most position (FIG. 2). To move to the TV position, ottoman drive motor 158 is engaged, moving the extendable shaft of ottoman drive motor 158 forward, which in turn moves the ottoman drive tube 128, ottoman drive tube bracket 126, secondary rear ottoman link 107, and rear ottoman link 106. As rear ottoman link 106 pivots about the connection to seat frame 12, the footrest assembly 16 moves from the closed position of FIG. 1 or 2, to the open position of FIG. 3. In this position, the back assembly 14 remains upright, resulting in the TV position.

Figure 3:
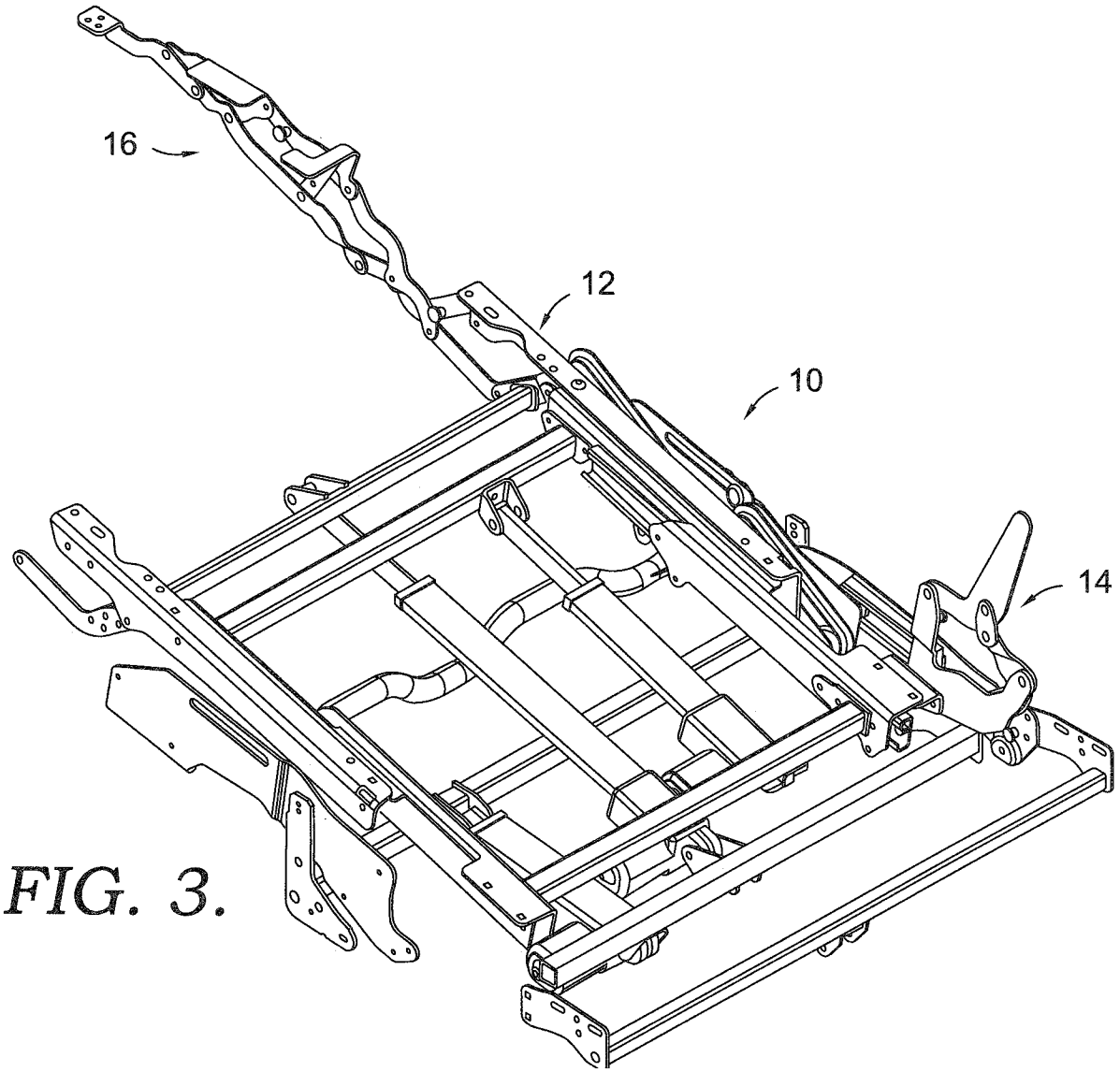
FIG. 3 is a view similar to FIG. 2, but showing the mechanism in the TV position, with the footrest extended.

To move from the TV position of FIG. 3 to the fully reclined position of FIG. 4, the ottoman drive motor 158 continues to move the extendable shaft of the ottoman drive motor 158 forward. This continued forward motion pulls footrest drive link 124 forward, which pulls or rotates rear pivot link 84 (counterclockwise from the perspective of FIGS. 3 and 4). The front pivot link 82 moves similarly, driven by trolley 80. This motion also drives the front roller 76 up front roller track 72 and the rear roller 78 up rear roller track 74, moving the seat frame 12 further forward. As the shaft of ottoman drive motor 158 extends, the back assembly 14 reclines, pulled by the movement of the seat frame 12, through seat frame extension 134, bracket 132, and moving the rear seat bracket 90 forward and down, as best seen by comparing FIGS. 3 and 4. To close the mechanism 10, the above process reverses.

A mechanism for a seating unit is provided that has a pair of spaced apart first and second base plates, coupled together in spaced relation, each base plate having a front end and a rear end. A pair of mechanisms are included that are operable to move between a closed position and at least a reclined position, with one mechanism coupled to each base plate. Each mechanism includes a seat frame assembly; a back assembly pivotably coupled to the base plate; and a footrest linkage coupled to the seat frame assembly, having an extendable footrest, such that the footrest linkage moves the footrest between a retracted position when the mechanism is in the closed position and an extended position when the mechanism is in the reclined position. The seat frame assembly is coupled to the base plate to allow translational movement relative to the back assembly, such that the seat frame is able to move forward toward the front end of the base plate and backward toward the rear end of the base plate relative to the back assembly.

In some aspects, on the mechanism for the seating unit, the footrest linkage moves with the seat assembly such that the footrest linkage moves forward and backward relative to the back assembly in coordination with the seat assembly.

In some aspects, the mechanism for a seating unit further includes a first actuator coupled between the pair of mechanisms and coupled on one end to a respective back assembly, and on the opposite end to a respective seat frame assembly, such that actuation of the first actuator moves the seat frame assembly with respect to the back frame assembly.

In some aspects, on the mechanism for a seating unit, the seat frame assembly includes: a carrier plate translationally coupled to the base plate, such that the carrier plate is moveable forward and backward relative to the base plate; a seat frame coupled to the carrier plate; and a roller track coupled to the seat frame; wherein the back assembly includes at least a rear seat bracket and a roller support bracket that supports first and second rollers, with the roller track of the seat assembly moveable with respect to the rear support bracket and constrained by the first and second rollers and the roller support bracket.

In some aspects, on the mechanism for a seating unit the end of the first actuator coupled to the back assembly is at least indirectly coupled to the roller support bracket.

In some aspects, on the mechanism for a seating unit the coupling of the carrier plate to the seat frame includes: first and second inclined roller tracks fixed to the carrier plate; a trolley having a first roller coupled to the first roller track, a second roller coupled to the second roller track; and a front pivot link coupled on one end to the trolley near the first roller and coupled on the other end to the seat frame; and a second pivot link coupled on one end to the trolley near the second roller and coupled on the other end to the seat frame.

In some aspects, the mechanism for a seating unit further includes a second actuator coupled on one end to the roller support bracket and on the other end to the footrest linkage assembly, the second actuator operable to move the footrest linkage from the closed position to the extended position.

In some aspects, the mechanism for a seating unit further includes a third actuator coupled on one end to the carrier plate, and on the other end to the base plate.

In some aspects, on the mechanism for a seating unit the first actuator and the third actuator are coordinated in movement to move at the same time and direction.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

What is claimed is:

1. A recliner mechanism for a seating unit, comprising:

a pair of base plates, coupled together in spaced relation, each base plate having a front end and a rear end; and a pair of mechanisms operable to move between a closed position and at least a reclined position, with one mechanism coupled to each base plate, each mechanism comprising:

a seat frame assembly, a first roller track and a second roller track, a trolley comprising a first roller coupled to the first roller track and a second roller coupled to the second roller track, a back assembly pivotally coupled to the base plate, and a footrest linkage coupled to the seat frame assembly and having an extendable footrest, wherein the footrest linkage moves the extendable footrest between a retracted position when the mechanism is in the closed position and an extended position when the mechanism is in the reclined position, wherein the trolley allows the seat frame assembly to translate forward and backward relative to the back assembly.

2. The recliner mechanism of claim 1, wherein the seat frame assembly comprises a carrier plate translationally coupled to the base plate, such that the carrier plate is moveable forward and backward relative to the base plate.

3. The recliner mechanism of claim 2, wherein the first roller track and the second roller track are fixed to the carrier plate.

4. The recliner mechanism of claim 1, wherein each mechanism further comprises a front pivot link coupled on one end to the trolley near the first roller and coupled on an opposite end to the seat frame and a second pivot link coupled on one end to the trolley near the second roller and coupled on an opposite end to the seat frame.

5. A recliner mechanism for a seating unit, comprising:

a pair of base plates, coupled together in spaced relation, each base plate having a front end and a rear end; and a pair of mechanisms operable to move between a closed position and at least a reclined position, with one mechanism coupled to each base plate, each mechanism comprising:

a seat frame assembly;

a roller track, a trolley having a roller coupled to the roller track, a back assembly pivotally coupled to the base plate, and a footrest linkage coupled to the seat frame assembly and having an extendable footrest, wherein the footrest linkage moves the extendable footrest between a retracted position when the mechanism is in the closed position and an extended position when the mechanism is in the reclined position, wherein the seat frame assembly is coupled to the base plate so as to allow for translational movement relative to the back assembly, and wherein the roller track is inclined relative to a direction of translation of the seat frame assembly.

6. The recliner mechanism of claim 5, wherein the seat frame assembly includes a carrier plate translationally coupled to the base plate, such that the carrier plate is moveable forward and backward relative to the base plate.

7. The recliner mechanism of claim 6, wherein the roller track is fixed to the carrier plate.

8. A recliner mechanism for a seating unit, comprising:

a pair of base plates, coupled together in spaced relation, each base plate having a front end and a rear end; and a pair of mechanisms operable to move between a closed position and at least a reclined position, with one mechanism coupled to each base plate, each mechanism comprising:

a seat frame assembly;

a first roller track and a second roller track;

at least one roller coupled to the first roller track and at least one roller coupled to the second roller track;

a back assembly pivotally coupled to the base plate, and a footrest linkage coupled to the seat frame assembly and having an extendable footrest, wherein the footrest linkage moves the extendable footrest between a retracted position when the mechanism is in the closed position and an extended position when the mechanism is in the reclined position, wherein the seat frame assembly is coupled to the base plate so as to allow for translational movement relative to the back assembly.

9. The recliner mechanism of claim 8, wherein the seat frame assembly includes a carrier plate translationally coupled to the base plate, such that the carrier plate is moveable forward and backward relative to the base plate.

10. The recliner mechanism of claim 9, wherein the first roller track and the second roller track are fixed to the carrier plate.

11. The recliner mechanism of claim 8, wherein the first roller track and the second roller track are each inclined relative to a direction of translation of the seat frame assembly.

* * * * *